US005734997A

United States Patent [19]

Raff

[11] Patent Number: 5,734,997

[45] Date of Patent: Apr. 7, 1998

[54] PORTABLE TOILET SEAT BIDET ASSEMBLY

[76] Inventor: Darlene A. Raff, 425 Bardon St., Wooster, Ohio 44691

[21] Appl. No.: 612,538

[22] Filed: Mar. 8, 1996

[51] Int. Cl.[6] ..... A47K 3/22

[52] U.S. Cl. ..... 4/420.2; 4/445; 4/444

[58] Field of Search ..... 4/420.2, 420.3, 4/443, 444, 445, 447, 446, 448

[56] References Cited

U.S. PATENT DOCUMENTS

| | | | |
|---|---|---|---|
| 2,875,450 | 3/1959 | Umann | 4/420.2 |
| 3,577,567 | 5/1971 | Wintercorn | 4/445 |
| 3,879,769 | 4/1975 | Slawinski | 4/447 |
| 4,041,553 | 8/1977 | Sussman | 4/447 |
| 5,241,712 | 9/1993 | Mahoney | 4/420.2 |
| 5,361,427 | 11/1994 | Wilk | 4/420.3 |

*Primary Examiner*—David J. Walczak
*Attorney, Agent, or Firm*—Jerry Semer

[57] ABSTRACT

The present invention is a raised toilet seat that fits both elongated and regular toilet bowls. Within the raised toilet seat is a water channel that runs water to perforation on the side of the raised toilet seat that allows the water to spray upon an individual sitting on the seat. A water line runs out of the side of the toilet seat. This water line can be flexible and can be attached with a coupling to a faucet of a sink near the toilet. The bidet could also be placed in the toilet permanently by hooking the water line to the hot and cold water lines of the sink next to the toilet in the bathroom. In this embodiment the lines from the hot and cold water line to the sink would run into a temperature valve for setting the proper temperature of the water and then into a gate valve that would allow the individual to turn on and off the spray within the toilet seat. The line would then run out of the gate valve to the toilet seat and to the water channel of the seat. The toilet seat itself can be injection molded from plastic.

17 Claims, 7 Drawing Sheets

PORTABLE TOILET SEAT BIDET ASSEMBLY

FIELD OF THE INVENTION

The present invention relates to portable toilet seat bidet assembly and more particularly to a portable toilet seat bidet that fit on the existing toilet.

BACKGROUND OF THE INVENTION

There is a great need today for the old, Alzheimer patient, and the infirm for a toilet that cleans as well as gets rid of the waste product. The traditional answer to this is a bidet. Generally, however, bidet are separate structures positioned along side standard toilet bowls, thereby requiring much more room in a bathroom and are clearly not portable. Thus, one of the objectives of the patentee's invention is to devise a portable toilet bowl bidet assembly. A further objective of the inventor is to devise a toilet seat bidet that fits upon the existing toilet seat thus, taking up no further room in the bathroom. One attempt at doing this in the prior art is U.S. Pat. No. 5,279,001 to Vento. Vento has devised a device that fits upon the back of the toilet bowl with retractable spray nozzles that come out and wash the individual on the toilet seat. There are several problems with Vento. First, Vento has only two spray nozzles that come out and wash the individual. The present invention sprays all around from all angles and thus does a better cleansing job. Secondly, Vento's invention must be placed on the toilet permanently. The present invention is portable and can be removed from the toilet bowl easily. There is no need in the present invention for a retractable spray nozzle. Since the spray comes from a reasonably smooth side the spray will clean the bidet. Also the bidet can be removed from the toilet bowl for other individuals to use the toilet that do not need the bidet. Thus, the spray area does not become unsanitary. This greatly reduces the complexity of the invention and thus reduces the manufacturing costs, the repairs and makes it easier to use. One of the objectives of this invention is to invent a portable bidet that is easy to use and is inexpensive to manufacturer. Vento is even further complicated by the fact that it adds an extra reservoir for water to a toilet that needs to be hooked into place and the plumbing around the toilet needs to be changed. In the present invention the bidet is portable and can be easily hooked up to a sink faucet for its water supply.

Other type of bidet apparatus as those shown in Aoyama, U.S. Pat. No. 4,967,423 Kou, U.S. Pat. No. 4,850,060 and Baus, U.S. Pat. No. 4,321,715 also include nozzles formed and attached to toilet seats for use as a bidet. These assembly however, have permanent exposed spray nozzles that remain in position in the central opening of the toilet seat. As result the spray nozzles detract from the appearance of the toilet and can become easily contaminated during normal use of toilet bowl thereby lessening the sanitary condition of the bidet. Applicant's patent however can be removed from the toilet easily and thus does not have the problems of nozzles becoming unsanitary under normal use. Also, none of these devices are portable. All are far more complicated to manufacturer and to use then the present invention.

The device of the present invention overcomes the drawbacks of the prior art in that it is portable and can be carried with an individual. It is also portable enough that it can be removed from a toilet so that the toilet can be used for normal used without a bidet.

SUMMARY OF THE INVENTION

The present invention is a raised toilet seat that fits both elongated and regular toilet bowls. Within the raised toilet seat is a water channel that runs water to perforation on the side of the raised toilet seat that allows the water to spray upon an individual sitting on the seat. A water line runs out of the side of the toilet seat. This water line can be flexible and can be attached with a coupling to a faucet of a sink near the toilet. The bidet could also be placed in the toilet permanently by hooking the water line to the hot and cold water lines of the sink next to the toilet in the bathroom. In this embodiment the lines from the hot and cold water line to the sink would run into a temperature valve for setting the proper temperature of the water and then into a gate valve which would allow the individual to turn on and off the spray within the toilet seat. The line would then run out of the gate valve to the toilet seat and to the water channel of the seat. The toilet seat itself can be injection molded from plastic.

DETAILED DESCRIPTION OF THE PREFERRED EMBODIMENT

Figure 1:
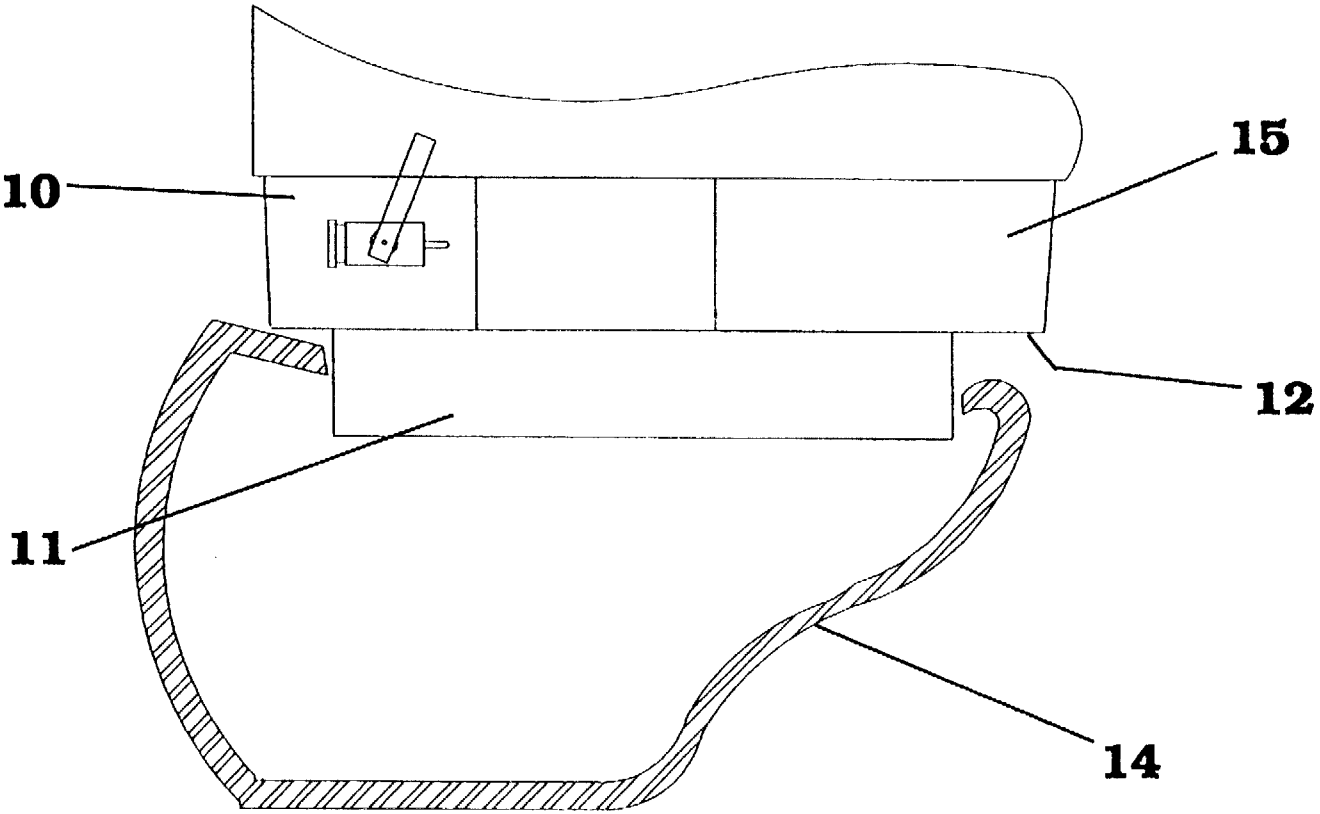
FIG. 1 shows a side view of the invention sitting on a toilet bowl with the bowl partially cut away.
Figure 2:
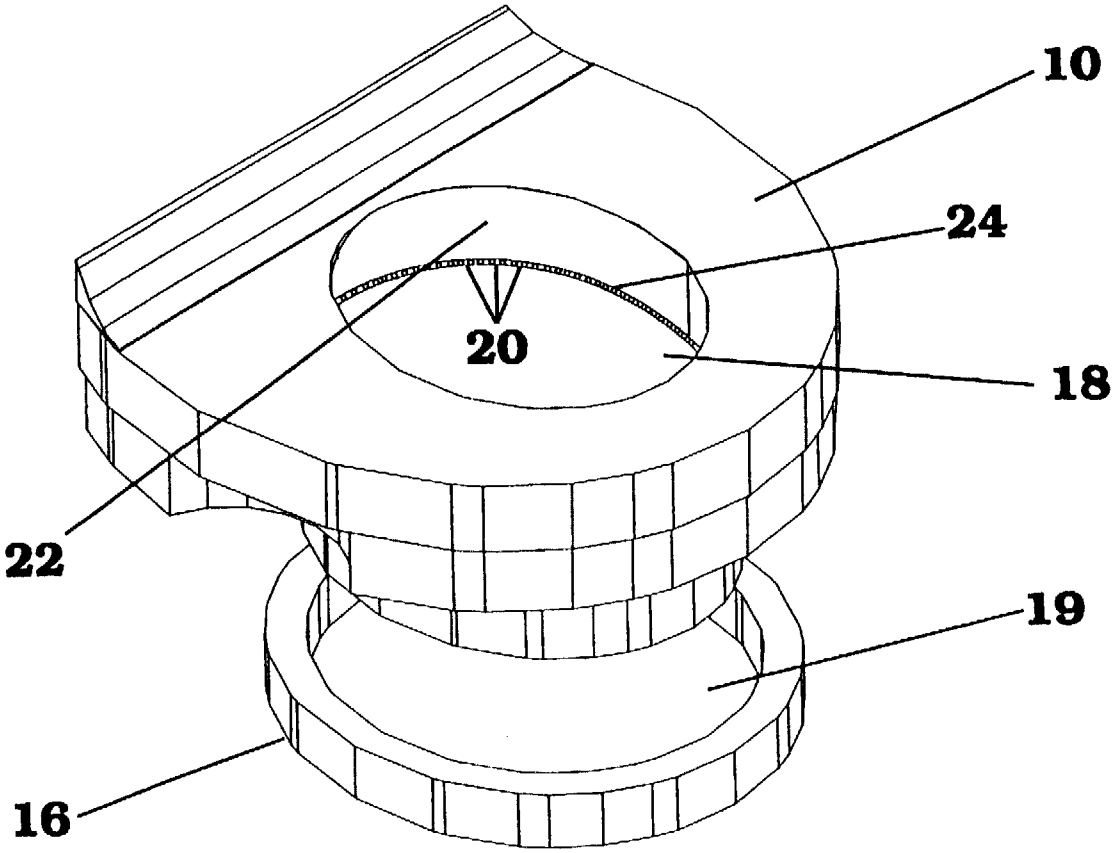
FIG. 2 shows a perspective view of the toilet seat sitting within the toilet bowl.

FIGS. 1 and 2 show the general shape of the toilet seat 10.

FIG. 1 is a side view of the toilet seat 10 setting on a toilet bowl 14 with the bowl partially cut away. The toilet seat's bottom 11 has a smaller diameter then the top 19. In the preferred embodiment approximately an inch and one half from the bottom 11 on the outside of the toilet seat is a ridge 12 that extends outward from the side at a right angle to the side. The ridge extends outward approximately three quarters of an inch to two inches. This ridge 12 is designed to set on the top rim of the toilet bowl 14. The toilet seat 10 then moves upward from that point approximately three to six inches.

Figure 3:
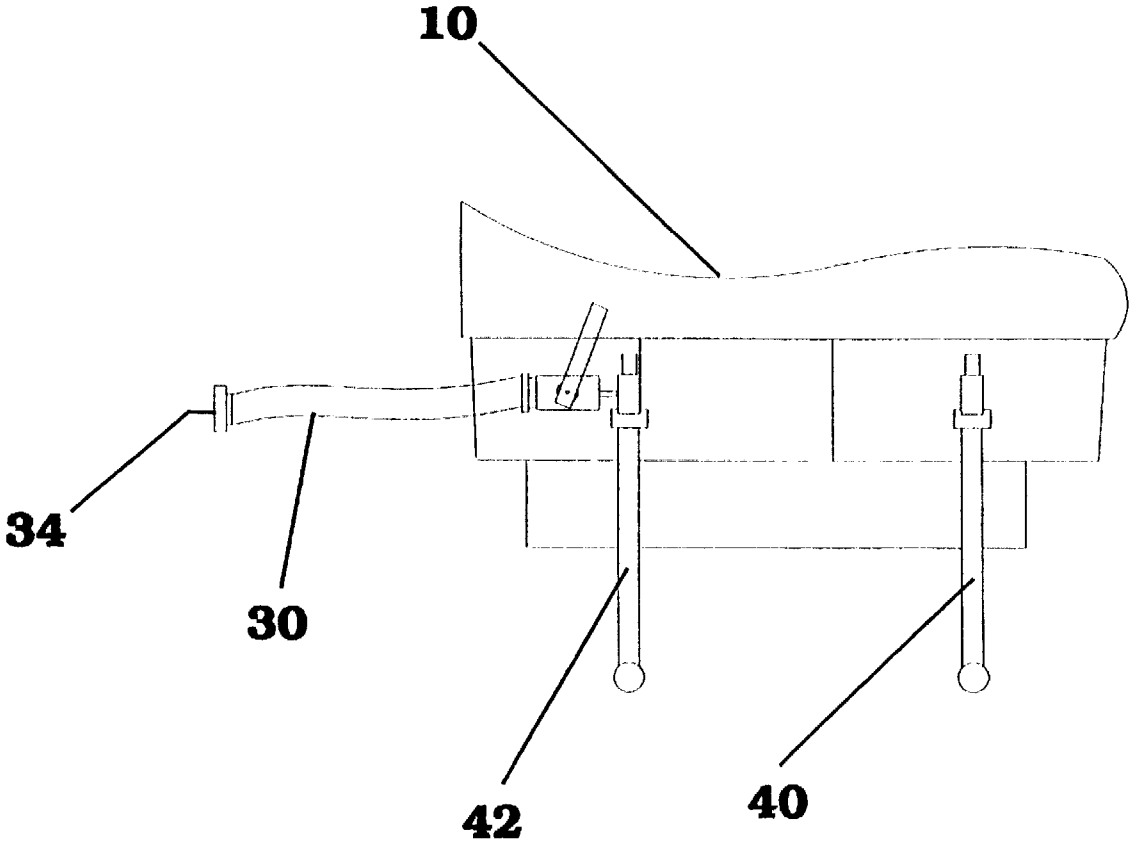
FIG. 3 shows a side view of another embodiment of the invention.
Figure 5:
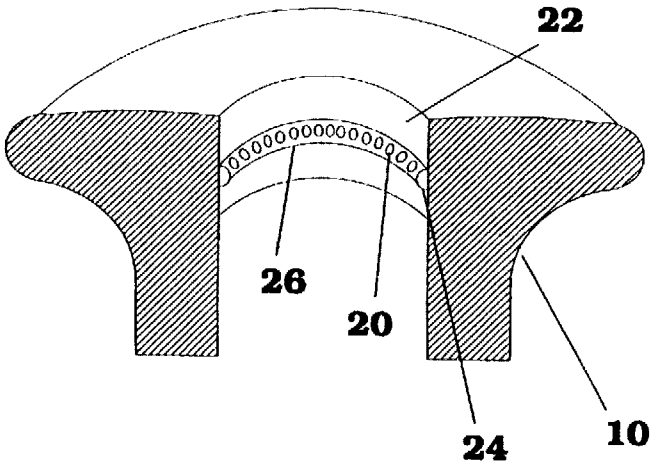
FIG. 5 is a cutaway view of the toilet seat of the invention.

FIG. 2 shows a perspective view of the toilet seat 10. As you can see from FIG. 2 the toilet seats 10 outer diameter of the top section is slightly larger than the outer diameter of the toilet bowl rim 16. This enables the toilet seat 10 to set securely within the toilet bowl 14. The inner diameter of the central opening 18 of the toilet seat 10 is smaller than the toilet opening 15 due to the necessity of the lower portion of the toilet seat 10 fitting within the toilet bowl opening 15 to hold the toilet seat securely. The toilet seat 10 can also be held more securely by clipping it to the rim 16 of the toilet bowl 14 as shown in FIG. 3. FIG. 2 shows on the inner surface 22 of the toilet seat 10 a set of perforations 20. These perforations 20 allow the water to spray upward toward a person setting on the seat 10. The inner surface 22 of the toilet seat 10 is reasonably smooth and vertical except the area on which the perforations 20 are made. This is to enable the toilet seat 10 to stay reasonably clean. In the preferred embodiment there is a slight bump 24 at the point where the perforations 20 are made with the perforations 20 on the top side of the bump 24 as shown in FIG. 5. This allows the water to be directed upward toward the individual setting on the toilet seat 10. This bump 24 could be formed by a tubular channel 26 attached to the inside of the toilet seat.

FIG. 3 shows a side view of the invention. FIG. 3 shows the hook 40 that can be attached to the toilet seat 10 to hold it firmly on the toilet bowl 14. FIG. 3 shows two hooks 40 on the one side of the toilet seat 10. There are also two other hooks 40 not shown on the other side. The hooks 40 are attached to the toilet seat 10 and can be swung inward towards the toilet bowl 14 or away from it. The hooks 40 are designed to fit under the rim 16 on the top of the toilet bowl 14 and hold the toilet seat 10 on securely. The body 42 of the hook 40 is slightly flexible and bent in a concave fashion. The body 42 of the hook 40 is made out of springy material and the tip 44 of hook 40 when properly located will not quite fit under the rim 16 of the toilet bowl 14. As the hook 40 is pushed under this rim 16 the tip 44 of the hook 40 is pushed away and it snaps into place under the rim 16 holding the toilet seat 10 securely. In the preferred embodiment the tip 44 is made out of rubber to functionally hold the toilet seat 10 inversely.

Figure 6:
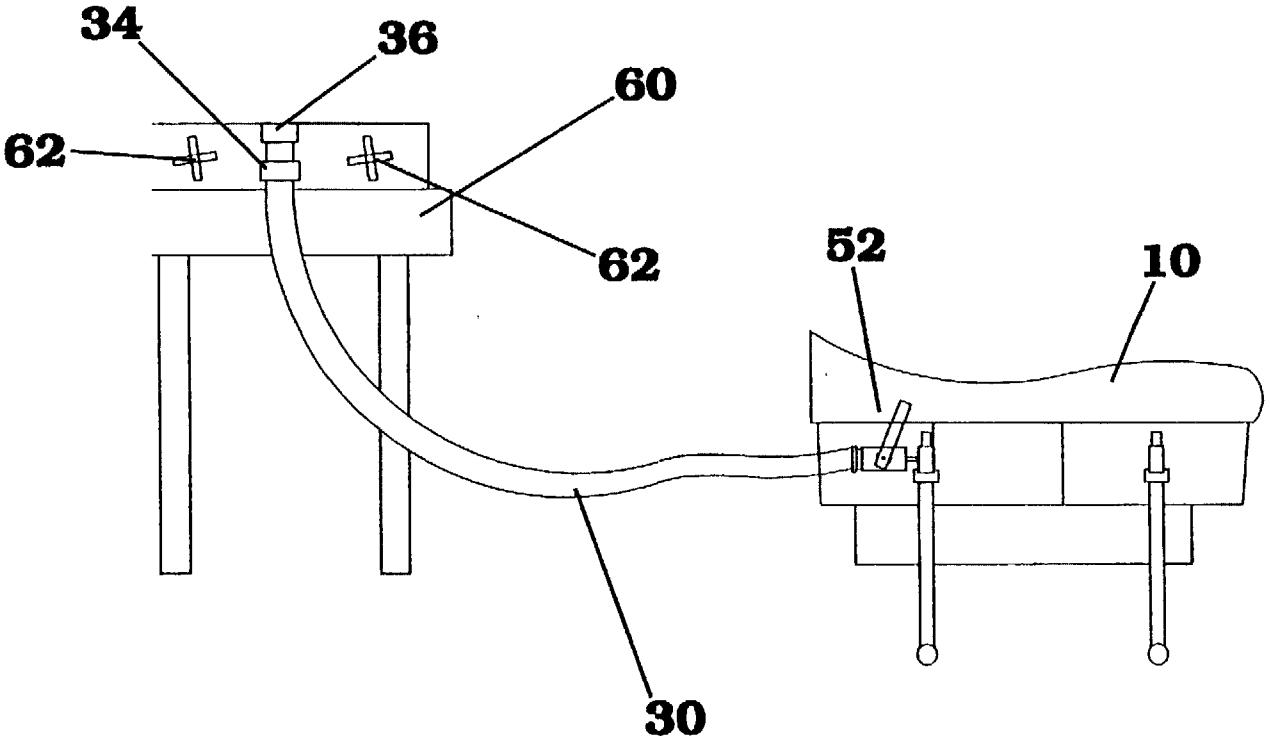
FIG. 6 shows the invention attached to a sink faucet.
Figure 7B:
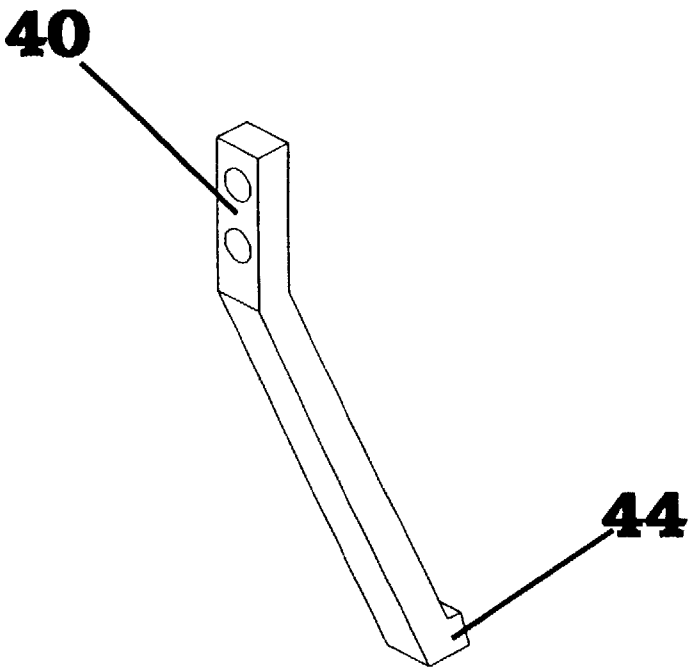
FIG. 7*b* is a perspective view of the hook 40.
Figure 7A:
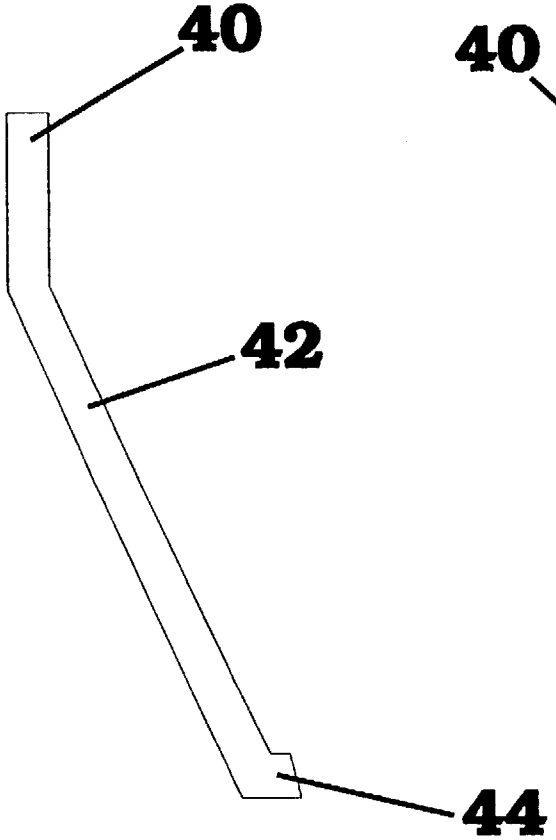
FIG. 7*a* is a side view of the hook 40.
Figure 7:
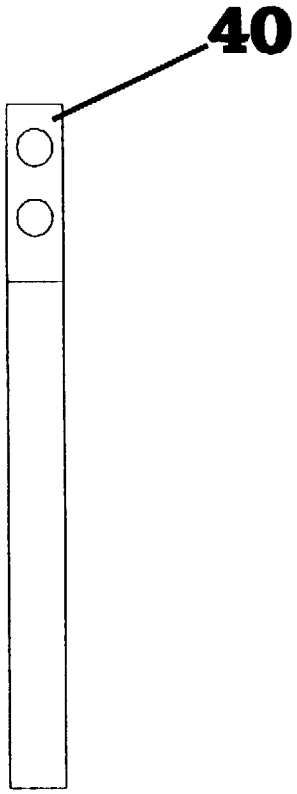
FIG. 7 is a front view of the hook 40.

FIG. 3 also shows a water line 30 running out of the toilet seat 10. Water line 30 feeds the water to the canal 26 on the inside of the toilet seat that allows the water to pass through the perforations 20 and up toward the individual setting on the seat. In one embodiment of the invention on the end water line 30 is an adapter 34 that can be attached to a sink faucet 36 as in FIG. 6. In this embodiment the water line 30 is flexible.

Figure 4:
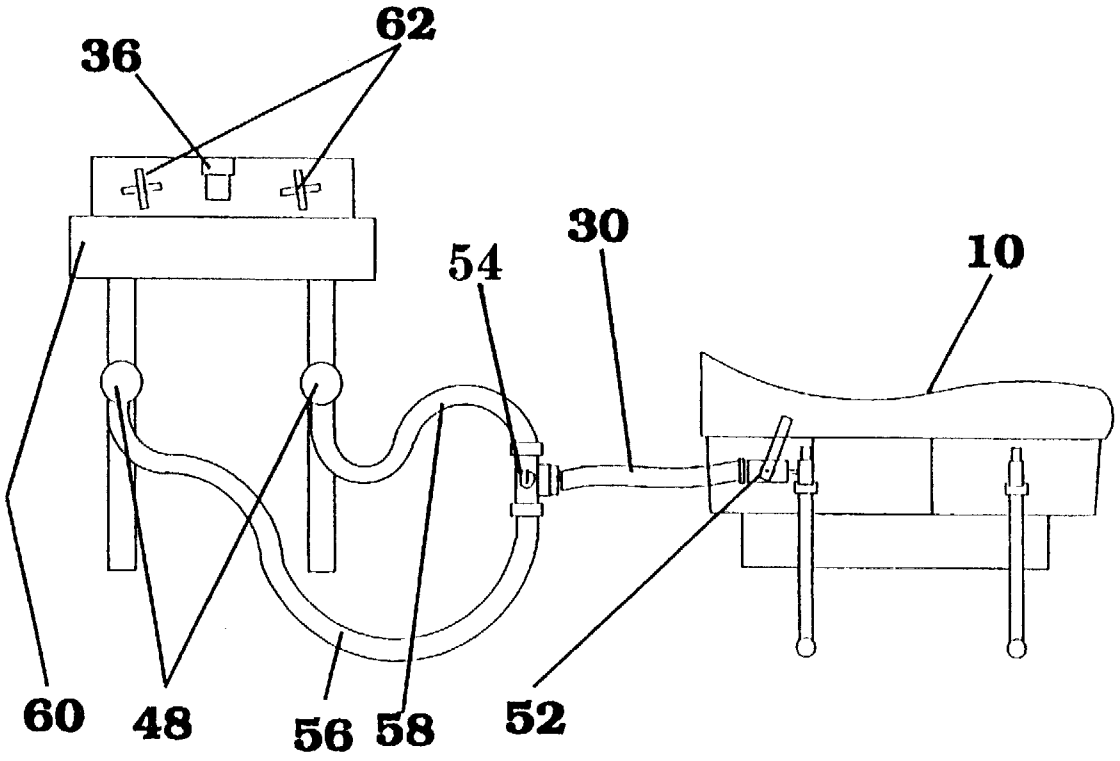
FIG. 4 shows the invention hooked to the hot and cold water lines of a sink.

In another embodiment shown in FIG. 4 water line 30 is attached to the cold and hot waterlines 48 of a sink 60 beside the toilet bowl 14. In this embodiment water line 30 is attached to a valve 52. This valve 52 controlls the flow of water to the toilet seat 10. In one embodiment shown in FIG. 4 valve 52 is attached to a temperature control valve 54. In another embodiment, the temperature control valve and the valve to control the flow of water to the toilet seat is combined into one valve. This valve mixes the hot and cold water so that an individual can get a certain temperature as to the water flowing into the toilet seat. This temperature control valve 54 has two lines 56 and 58 running from it. In this embodiment an individual would attach the two lines 56 and 58 running from valve 54 to the hot and cold water lines 48 running to a sink 60. The water from the hot and cold water lines 48 would run to temperature control valve 54 and valve 54 would mix the water and the water would then flow into valve 34 where the individual setting on the toilet seat 10 could control the amount of flow into the toilet seat 10.

In the preferred embodiment water line 30 directly runs to the sink 60 and attaches to the faucet 36 with adapter 34. An individual who wishes to control the temperature of the water under this situation would use the handles 62 of the sink 60 to control the temperature. Water line 30 could also contain a valve 34 that would control the rate of flow into the seat. However, the rate of flow into the toilet seat 10 could also be controlled by the handles 62 on the sink 60.

Changes and modification in specifically described embodiment can be carried out without departing from the scope of the invention that is intended to be limited only by the scope by the appending claims.

I claim:

1. A toilet seat bidet for use with a toilet bowl comprising:

a. a toilet seat with a central opening which allows the waste to pass from above the toilet seat into the toilet bowl and said central opening having an inner surface the toilet seat having a top portion, a bottom portion and an outer surface having an outer diameter and at the top portion wherein the outer diameter is larger than an outer diameter of the bottom portion such that the outer surface of the toilet seat forms a ridge on the outer surface and said ridge is adapted to sit on the toilet bowl's annular rim and said bottom portion outer diameter is less than the toilet bowl's inner diameter thus the outer surface of the toilet seat extends into the toilet bowl securely holding the toilet seat in place on the toilet bowl and, b. a channel with a side, with perforations on the side, attached to the inner surface of the central opening such that when the water rims through the channel the water will squirt out the perforations on the side of the channel and clean a person sitting on the toilet seat; and, c. a means for attaching the channel to a water supply.

2. A toilet seat bidet as in claim 1 further comprising:

a. a valve attached to the means for attaching the channel to a water supply and said valve controls the flow of water through the means for attaching and said valve can be operated by an individual.

3. A toilet seat bidet as in claim 2 wherein:

a. the means for attaching the channel to a water supply attaches the channel to a water supply that supplies both hot and cold water.

4. A toilet bidet as in claim 3 wherein:

a. the means for attaching the channel to the water supply with hot and cold water is a hose attached to the channel at one end and said hose is removably attachable to a sink faucet at the other end.

5. A toilet seat as in claim 2 wherein:

a. the means for attaching is a hose that attaches to the channel at one end and attaches to the valve and said valve is attached to a hot water supply by a hose and to a cold water supply by another hose.

6. A toilet seat bidet as in claim 5 wherein:

a. the valve mixes the hot and cold water to achieve a certain temperature.

7. A toilet seat bidet as in claim 1 wherein:

a. the water supply supplies both hot and cold water; and, b. the means for attaching the channel to the water supply contains a valve that mixes the hot and cold water to achieve a certain temperature.

8. A toilet seat bidet as in claim 1 wherein:

a. the channel extends substantially around the central opening, such that when the water flows through the channel the water will squirt out of the perforations and clean an individual on the toilet seat.

9. A toilet seat bidet as in claim 1 wherein:

a. the water supply supplies both hot and cold water supplies; and, b. the means for attaching the channel to the water supply attaches the channel to both the hot and cold water supplies.

10. A toilet bidet as in claim 1 wherein:

a. the means for attaching the channel to the water supply is a hose attached to the channel at one end and said hose is removeably attachable to a sink faucet at the other end.

11. A toilet seat bidet as in claim 1 wherein:

a. the inner surface has a top and middle and the channel is located closer to the middle than the top.

12. A toilet seat bidet as in claim 1 further comprising:

a. a means for attaching the toilet seat to the toilet bowl.

13. A toilet seat bidet as in claim 12 wherein:

a. the toilet bowel has a rim; and, the means for attaching the toilet seat to the toilet bowl is a set of hooks that attach to the toilet seat and are adopted to hook under the rim of the toilet bowl, holding the toilet seat securely upon the toilet bowl.

14. A toilet seat bidet for use with a toilet bowl comprising:

a. a toilet seat with a central opening that is adapted to sit securely on the toilet bowl and said central opening allows the waste to pass from above the toilet seat into the toilet bowl and said central opening has an inner surface; and b. a channel that extends substantially around the central opening, and said channel has a side with perforations spaced substantially around the central opening, and said channel is attached to the inner surface of the central opening such that when the water runs through the channel the water will squirt out the perforations on the side of the channel and clean a person sitting on the toilet seat; and, c. a means for attaching the channel to a water supply.

15. A toilet seat bidet as in claim 14 further comprising:

a. a means for attaching the toilet seat to the toilet bowl.

16. A toilet seat bidet as in claim 15 wherein:

a. the toilet bowel has a rim; and, the means for attaching the toilet seat to the toilet bowl is a set of hooks that attach to the toilet seat and are adapted to hook under the rim of the toilet bowl, holding the toilet seat securely upon the toilet bowl.

17. A toilet seat bidet as in claim 14 wherein:

a. the inner surface has a top and middle and the channel is located closer to the middle than the top.

* * * * *